US006454225B1

(12) United States Patent
Jaworski

(10) Patent No.: US 6,454,225 B1
(45) Date of Patent: Sep. 24, 2002

(54) STAND FOR A POTTED PLANT

(76) Inventor: Christopher J. Jaworski, 54655 Birch Rd., Osceola, IN (US) 46561

( * ) Notice: Subject to any disclaimer, the term of this patent is extended or adjusted under 35 U.S.C. 154(b) by 0 days.

(21) Appl. No.: 09/817,335

(22) Filed: Mar. 26, 2001

(51) Int. Cl.[7] ..... A47G 23/02

(52) U.S. Cl. ..... 248/153; D6/403; 47/39; 248/27.8; 248/175; 248/519

(58) Field of Search ..... 248/153, 152, 248/175, 519, 523, 524, 27.8; 47/39; D6/403

(56) References Cited

U.S. PATENT DOCUMENTS

| | | | | | |
|---|---|---|---|---|---|
| D76,321 | S | * | 9/1928 | Paull | D6/403 |
| D198,802 | S | * | 8/1964 | Cucullo | D6/403 |
| D397,261 | S | * | 8/1998 | Sellers | D6/403 |
| D434,247 | S | * | 11/2000 | Rosenberg | D6/403 |

* cited by examiner

*Primary Examiner*—Ramon O. Ramirez
(74) *Attorney, Agent, or Firm*—R. Tracy Crump

(57) ABSTRACT

A stackable and interconnectable stand used for supporting potting containers to prevent accidental toppling of potted plants is disclosed. The body of the stand is constructed of a wire lattice or flat bands, which has six radially extending legs between which the potting container is secured. Each leg has an upward (hip) bend, which forms an inner leg segment, and a downward return (knee) bend, which forms an outer leg segment. The inner leg segments diverge upwardly to define an area for restrictively receiving a potting container with the side walls of the container restrictively held secure against inner leg segments. The inner leg segments diverge upward at an angle such that the side walls of potting containers of various dimensions will be in restrictive contact with at least some portion of the inner leg segment to firmly support the potting container within the stand. The stands can be stackable atop one another to provide convenient storage of the stands when unused. The stands can also be interconnected to support multiple potting containers.

14 Claims, 16 Drawing Sheets

STAND FOR A POTTED PLANT

This invention relates to a stand for a potted plant, and particularly a stackable and interconnectable stand for potted plants, that supports large potting containers and prevents tipping.

BACKGROUND OF THE INVENTION

Potted plants are well known in the nursery and floral industries. Once seedlings are grown to maturity, individual plants are transplanted into separate potting containers for convenient sale and transportation. Potted plants, particularly tall plants and flowers are easily tipped over. The weight of the soil and width of the potting container often does not provide a sufficient base to prevent the potted plant from being accidentally or inadvertently knocked over.

The toppling of potted plants is a particular problem for commercial nurseries, florists and retail garden centers. Obviously, plants can be damaged, but also potting containers can be broken and potting soil can be spilled and lost when a potted plant is toppled. Plants that are tipped over do not get watered and may die. In addition, plants lying on their sides generally do not sell because of the "unkept" appearance. Spilled soil also increases labor and material costs to the operation of the nursery.

Bedding plants in larger potting containers can reduce the toppling problem, but is not a desirable solution. Larger potting containers have larger footprints, which occupy valuable floor space in a nursery. The smaller the footprint of the potted plants, the more potted plants can occupy the available floor space, thereby reducing storage overhead. Consequently, more potted plants can be stored and displayed in the available floor space of the nursery, if the plants are bedded in just enough soil and in potting containers just large enough to support the plant. The small potting containers and crowded floor space in nurseries only add to the problem of toppling.

Potting containers have been developed that provide a wider foot print and stabler base for potted plants, although their use is most for end users. Typically, a large flange or rim is used to create a larger container footprint, which produces a stabler base for the potted plant. While these improved potting containers are more stable, they also cause a sacrifice of floor space. Conventional potting containers are stackable when unused, so that they can be easily stored. The feature that enlarges the footprint of the potting container often prevents the stackability of the containers, which reduces their desirability to a nursery. In addition, since the potting containers are often sold with the plants, the additional cost of the containers adds to the cost of the plants.

What is needed to address this problem is a stand which can be used to support potted plants bedded in potting containers of various shapes and dimensions, which can be easily stored in a small area.

SUMMARY OF INVENTION

The stand of this invention is used to support potting containers and prevent accidental toppling of potted plants. The body of the stand is constructed of a wire lattice of three flat bands, which has six radially extending legs between which the potting container is secured. The stand of this invention is constructed of a wire lattice or resilient metal strips, which are connected at their centers. Each leg has an upward (hip) bend, which forms an inner leg segment, and a downward return (knee) bend, which forms an outer leg segment. The inner leg segments diverge upwardly to define an area for restrictively receiving a potting container with the side walls of the container restrictively held secure against inner leg segments. The inner leg segments diverge upward at an angle such that the side walls of potting containers of various dimensions will be in restrictive contact with at least some portion of the inner leg segment to firmly support the potting container within the stand. Both embodiments of the stand can be stackable atop one another to provide convenient storage of the stands when unused. The stands also incorporate an interlocking leg design for supporting multiple pots.

Accordingly, an advantage of this invention is that the stand provides a stable base for plants bedded in potting containers.

Another advantage of the stand is that it uses six radially extending legs to support the potting containers and to provide a wide resilient base to prevent toppling.

Another advantage is that the stand can be used with potting containers of various shapes and dimensions.

Another advantage is that the stand of this invention, which is constructed of a welded wire lattice or metal strips, is relatively inexpensive to manufacture and very durable for commercial use.

Another advantage is that the large numbers of unused stands can be stacked atop one another for convenient floor space saving storage.

Another advantage is that the stands can be interconnected to support multiple potting containers.

Another advantage is that the stands can be positioned in close proximity to each other by interlacing the legs of the stands, which maximizes the use of floor space.

Another advantage is that the stands allows for improved drainage.

Another advantage is that the stands allows for improved retail sales display of the potted plants.

Other advantages will become apparent upon a reading of the following description.

BRIEF DESCRIPTION OF THE DRAWINGS

The preferred embodiments of the invention have been depicted for illustrative purposes only wherein.

DESCRIPTION OF THE PREFERRED EMBODIMENT

The preferred embodiments herein described are not intended to be exhaustive or to limit the invention to the precise form disclosed. They are chosen and described to explain the invention so that others skilled in the art might utilize its teachings. Several different embodiments of the stand of this invention are described herein. Three embodiments are constructed of a resilient wire lattice. Another set of embodiments are constructed of thin resilient bands. Both embodiments are designed to securely support conventional potting containers 2. Potting containers 2 are illustrated in shadow in each figure. Potting containers 2 have a circular base 4 and tapered conical side walls 6, which diverge to the open mouth 7. Both embodiments of the stand of this invention are design to accommodate potting containers of various sizes, which will be explained in detail hereafter.

Wire Lattice Embodiments

Figure 1:
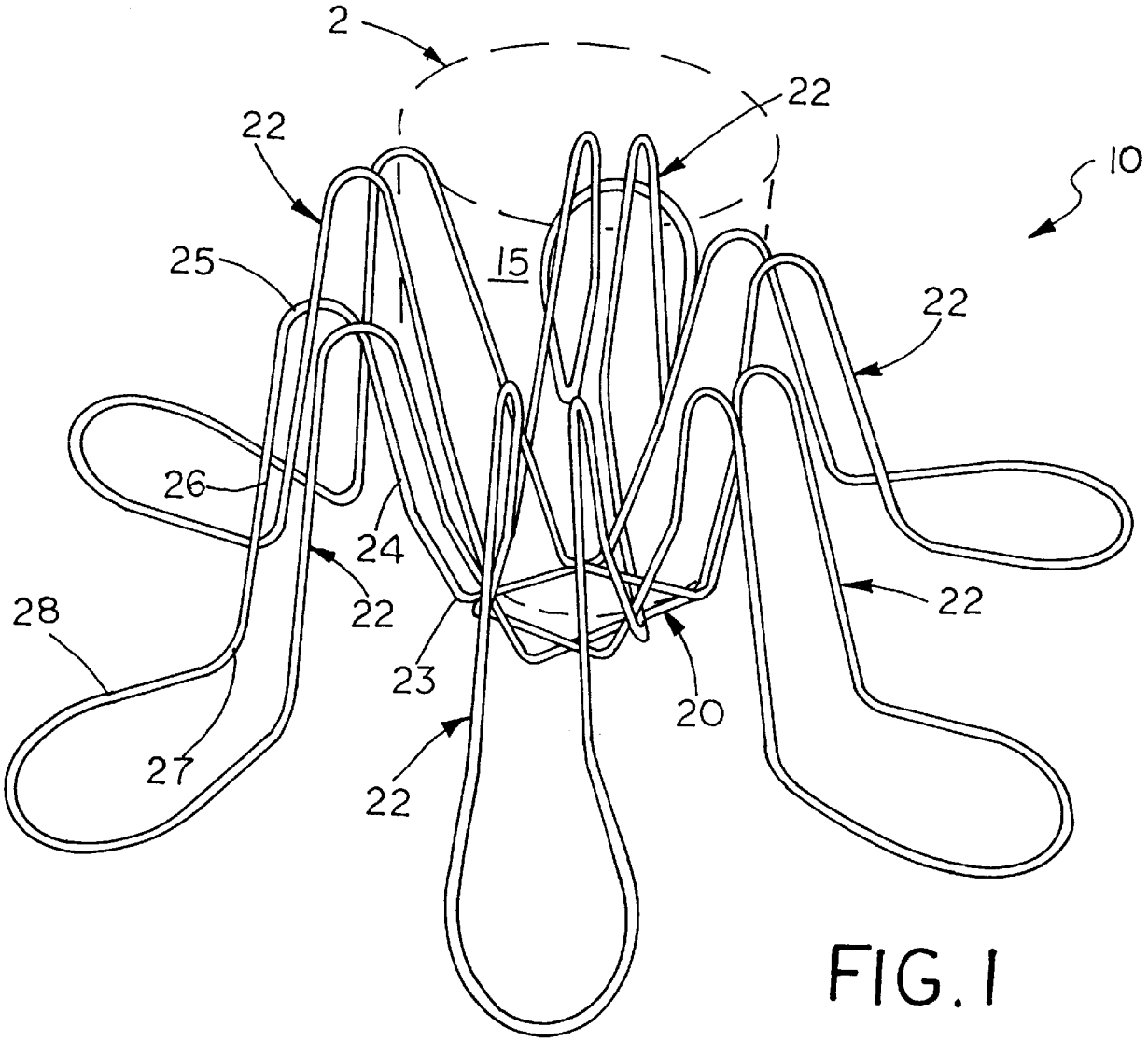
FIG. 1 is a perspective view of one embodiment of the stand of this invention showing a pot in shadow.
Figure 2:
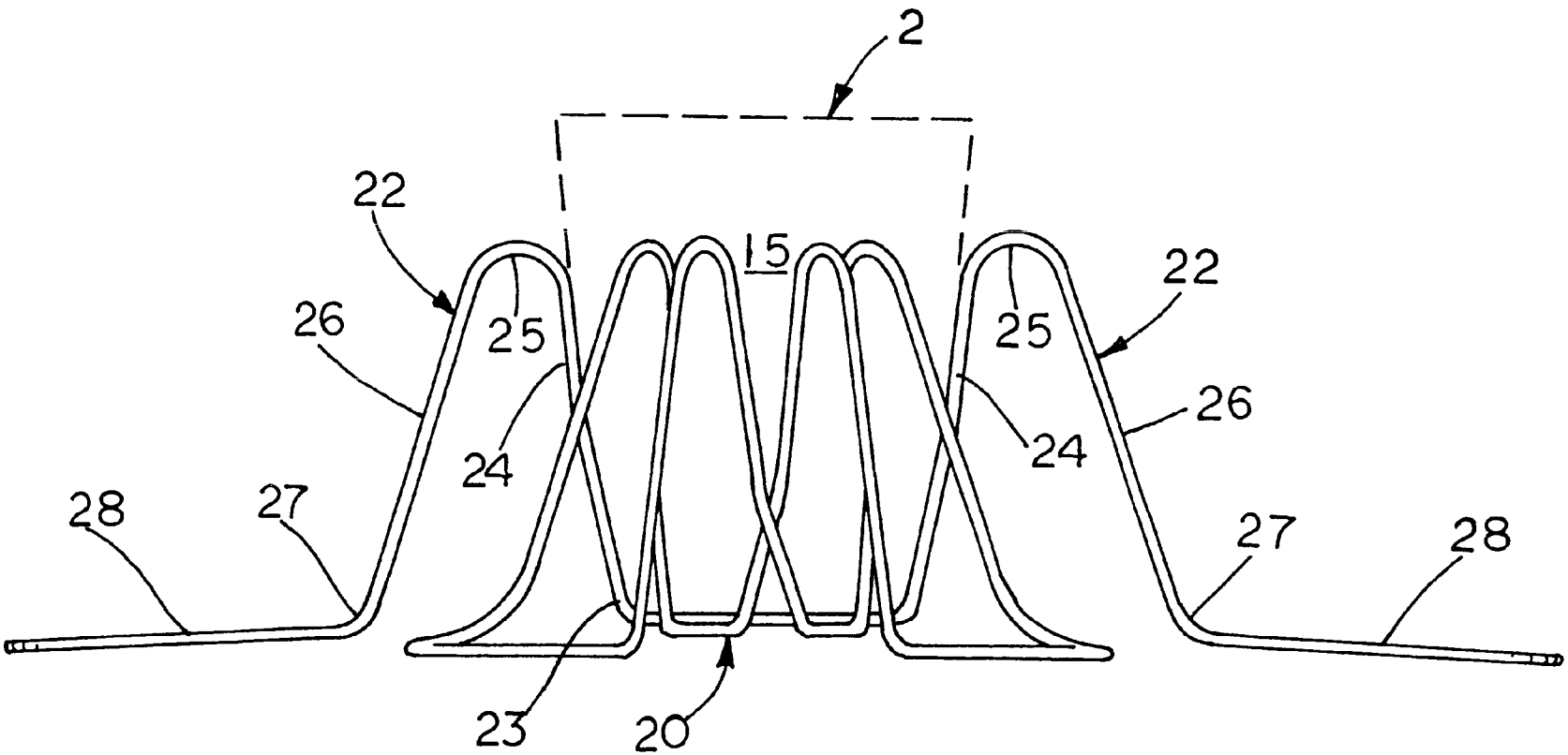
FIG. 2 is a side view of the first embodiment of the stand showing a pot in shadow.
Figure 3:
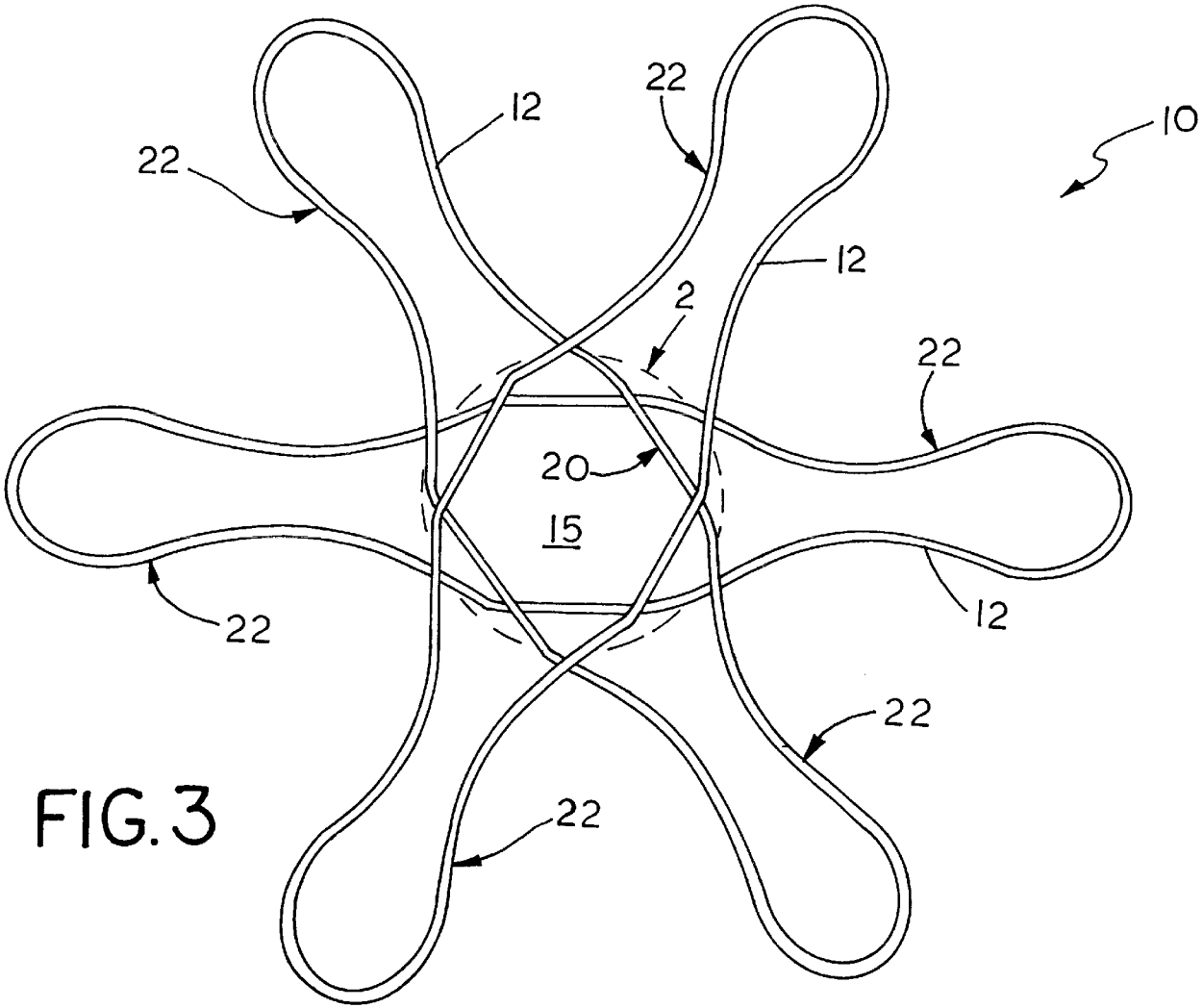
FIG. 3 is a top view of the first embodiment of the stand showing a pot in shadow.

FIGS. 1–4 illustrate the first embodiment of the wire stands of this invention, generally designated by reference numeral 10. As best shown in FIG. 3, stand 10 is constructed of a wire lattice of three elongated wire loops (designated as numeral 12 in FIG. 3 only). Each wire loop is constructed of a single strand of resilient metal wire connected end to end, which can be bent and welded. The wire loops are intercrossed and welded together at their centers such that the distal ends of each loop extends radially in a six pointed star configuration. The connected center portions of the wire loops form the base part 20 of stand 10 and the radially extending distal ends of the wire loops form the six legs 22 of the stand.

Figure 4:
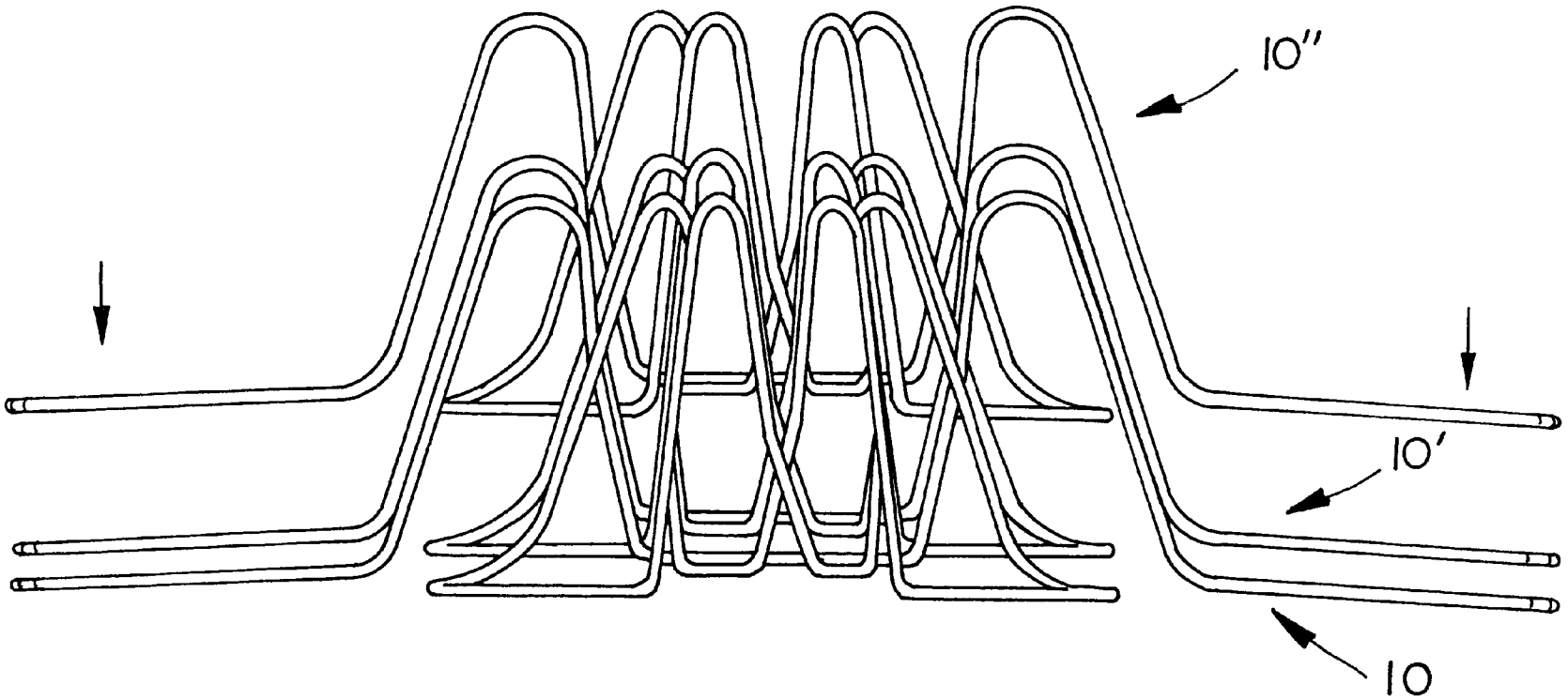
FIG. 4 is a side view of three stands of the first embodiment of the stand shown stacked atop one another in a storage position.

As best shown in FIGS. 1 and 2, each leg 22 has an upward (hip) bend 23 on either side of its base part 20, which forms an inner leg segment 24, and a downward return (knee) bend 25, which forms an outer leg segment 26. The distal ends of each leg 22 terminate in a foot segment 28, which is formed by an additional outward (ankle) bend 27. As shown in FIGS. 1 and 2, the inner leg segments 24 diverge upwardly to define an area 15 for restrictively receiving potting container 2. Potting containers 2 are nested within area 15 with the side walls of the container restrictively held secure against inner leg segments 24. Inner leg segment 24 diverge upward at an angle such that the side walls of potting containers of various dimensions will be in restrictive contact with at least some portion of the inner leg segment to firmly support the potting container within stand 10. Each pair of opposite legs 22 applies some pressure due to the resilience of the wire loop to container side walls 4 to secure potting container 2 within area 15. FIG. 4 illustrates that the configuration of stands 10 allow multiple stands to be stacked atop each other.

Figure 5:
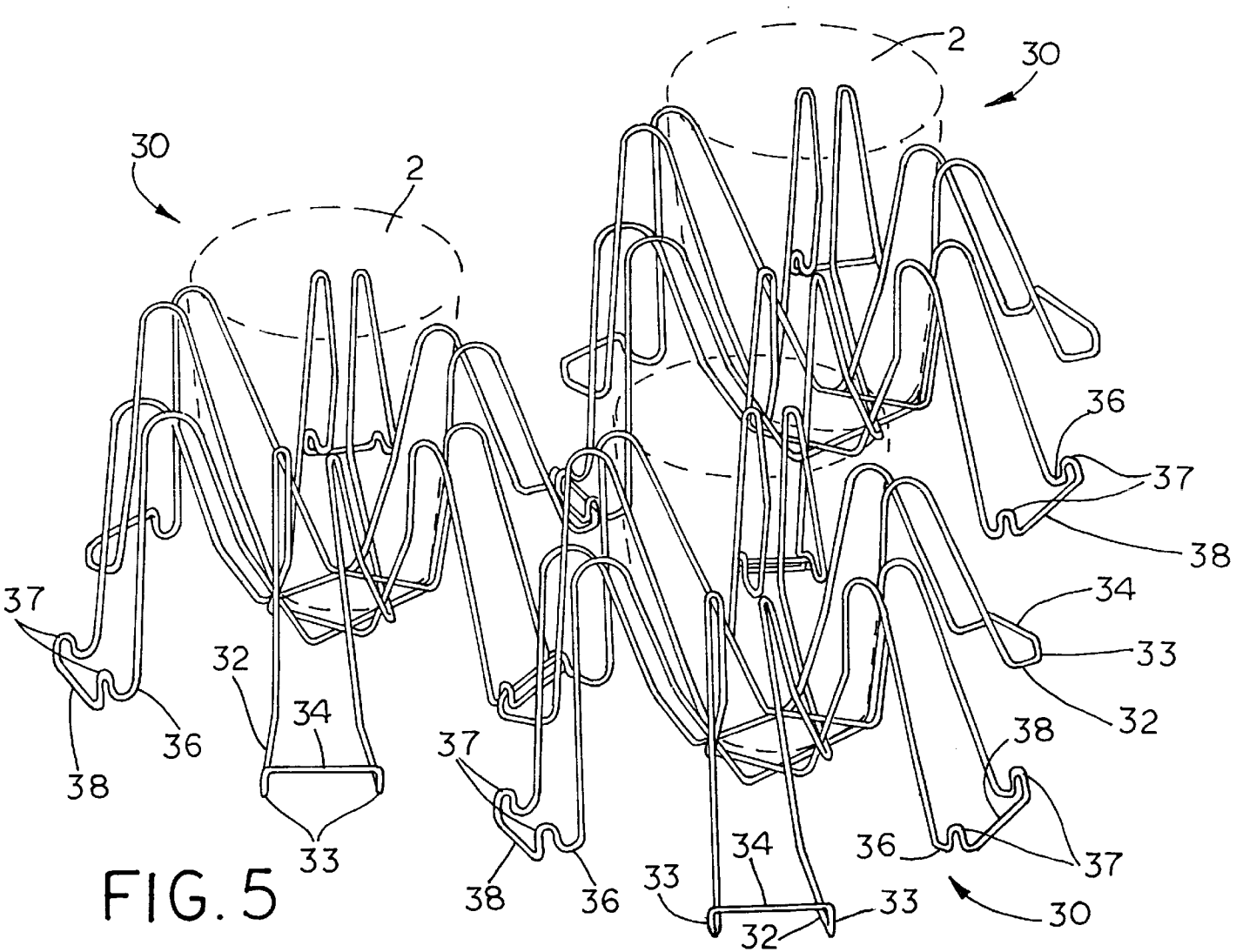
FIG. 5 is a perspective view of three interconnected stands of a second embodiment of the stand of this invention.
Figure 6:
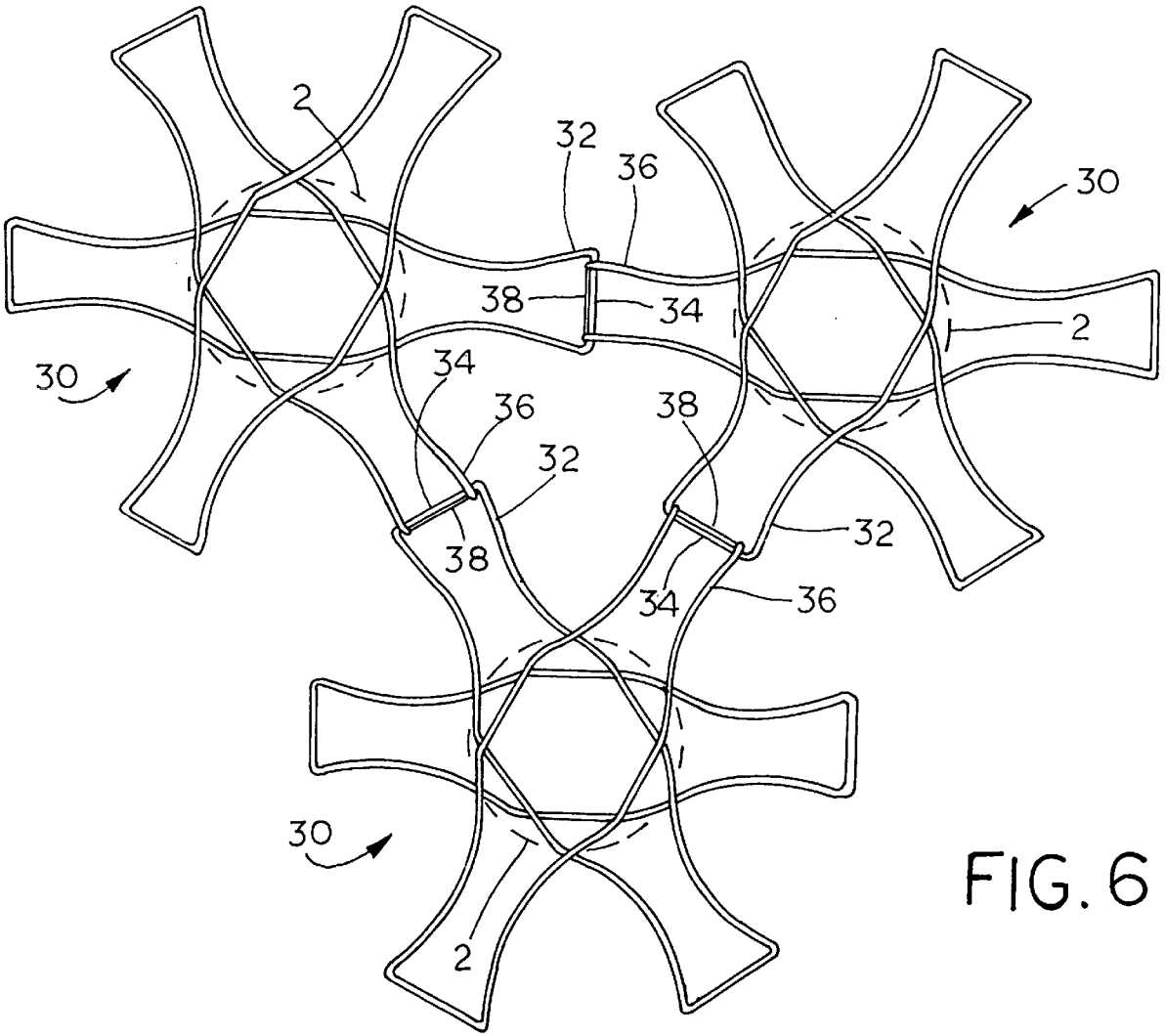
FIG. 6 is a top view of the three interconnected stands of a second embodiment of the stand of this invention.
Figure 7:
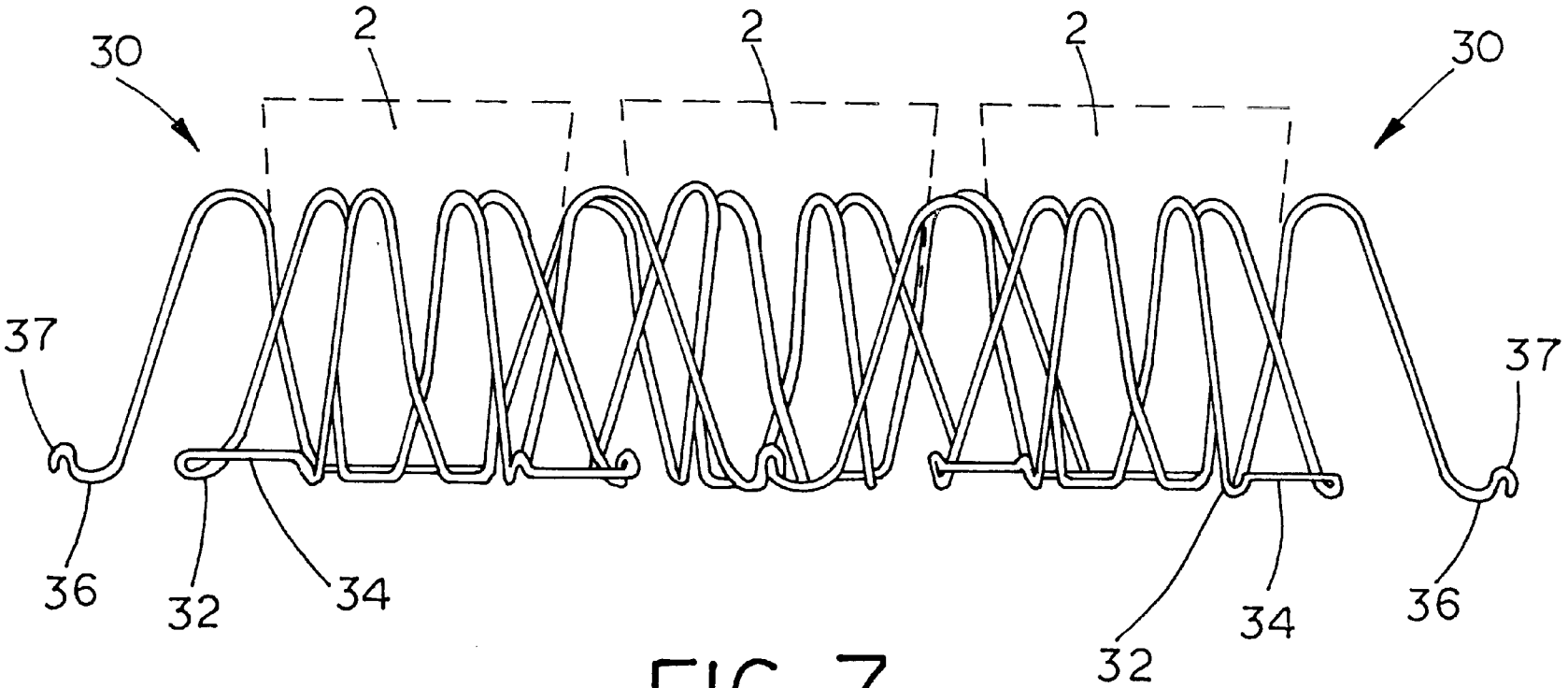
FIG. 7 is a side view of the three interconnected stands of a second embodiment of the stand of this invention.

FIGS. 5–7 show a second embodiment of the wire lattice stands, generally designated as numeral 30. As shown, stand 30 has the same basic construction as stand 10 of FIGS. 1–4 but allows for multiple stands to be interconnect to support multiple potting containers 2. As shown, the wire segments forming the feet of stand 30 have additional bends that form either a hook or a loop mechanism for interconnecting complimentary feet of another stand 30. One set of alternating feet 32 has an upward bend 33 and a raised cross member 34, which form the hook of the interconnecting mechanism. The other set of feet 36 has an upward and return bend 37, which forms an annular loop of the interconnecting mechanism. As shown, adjacent stands 30 are interconnected by mating the cross member 34 (hook) of leg 32 of one stand 30 with upward and return bend 37 (loop) of foot 36 of another stand 30. In this manner, multiple stands can be interconnected, which allows multiple pots to be supported. As shown in FIG. 6, three stands 30 can be interconnected in a triangular pattern. In addition, the interconnected stands 30 provide a greater securing, since one stand helps support the other interconnected stands.

Figure 8:
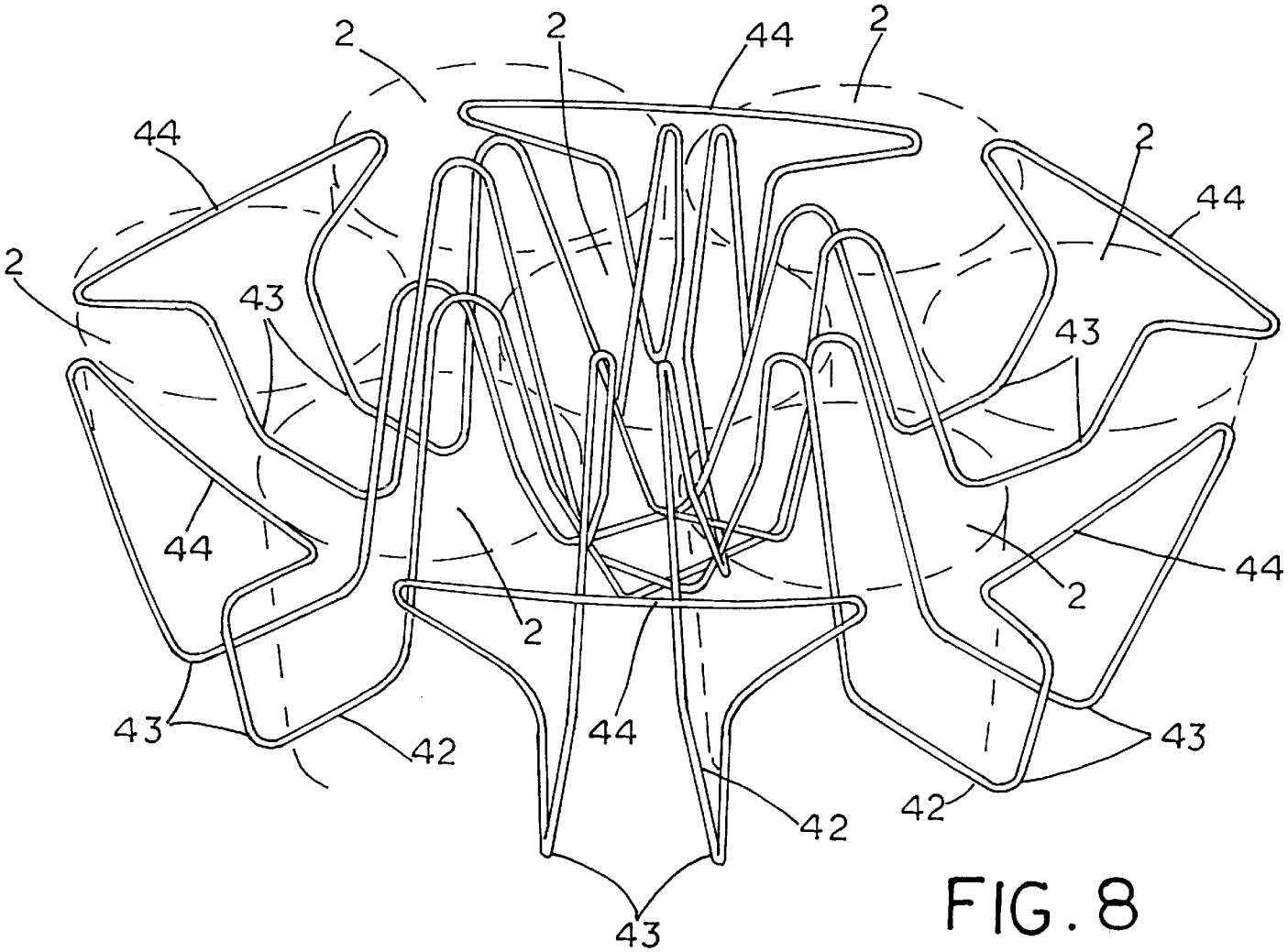
FIG. 8 is a perspective view of a third embodiment of the stand of this invention.
Figure 9:
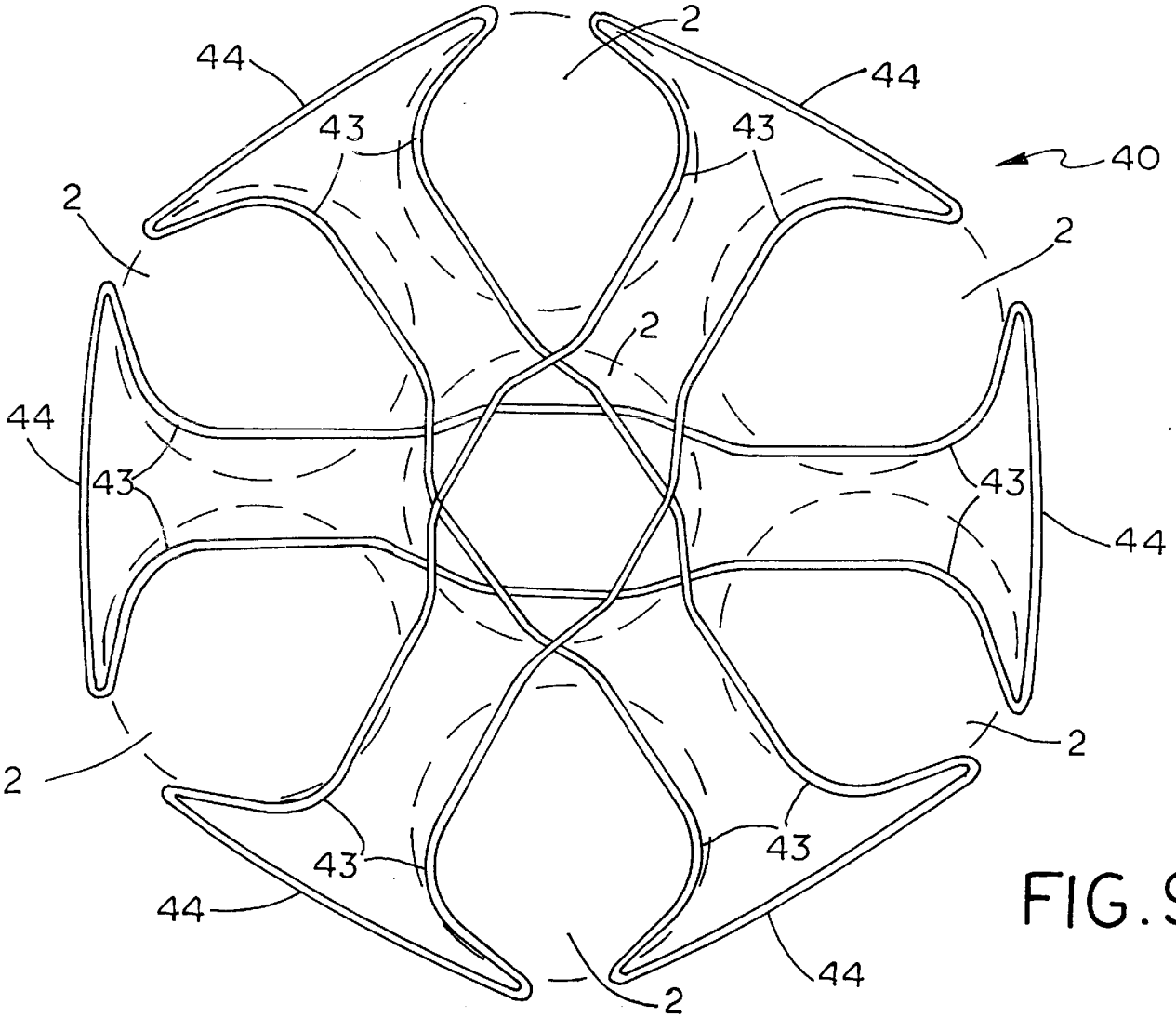
FIG. 9 is a top view of a third embodiment of the stand of this invention.
Figure 10:
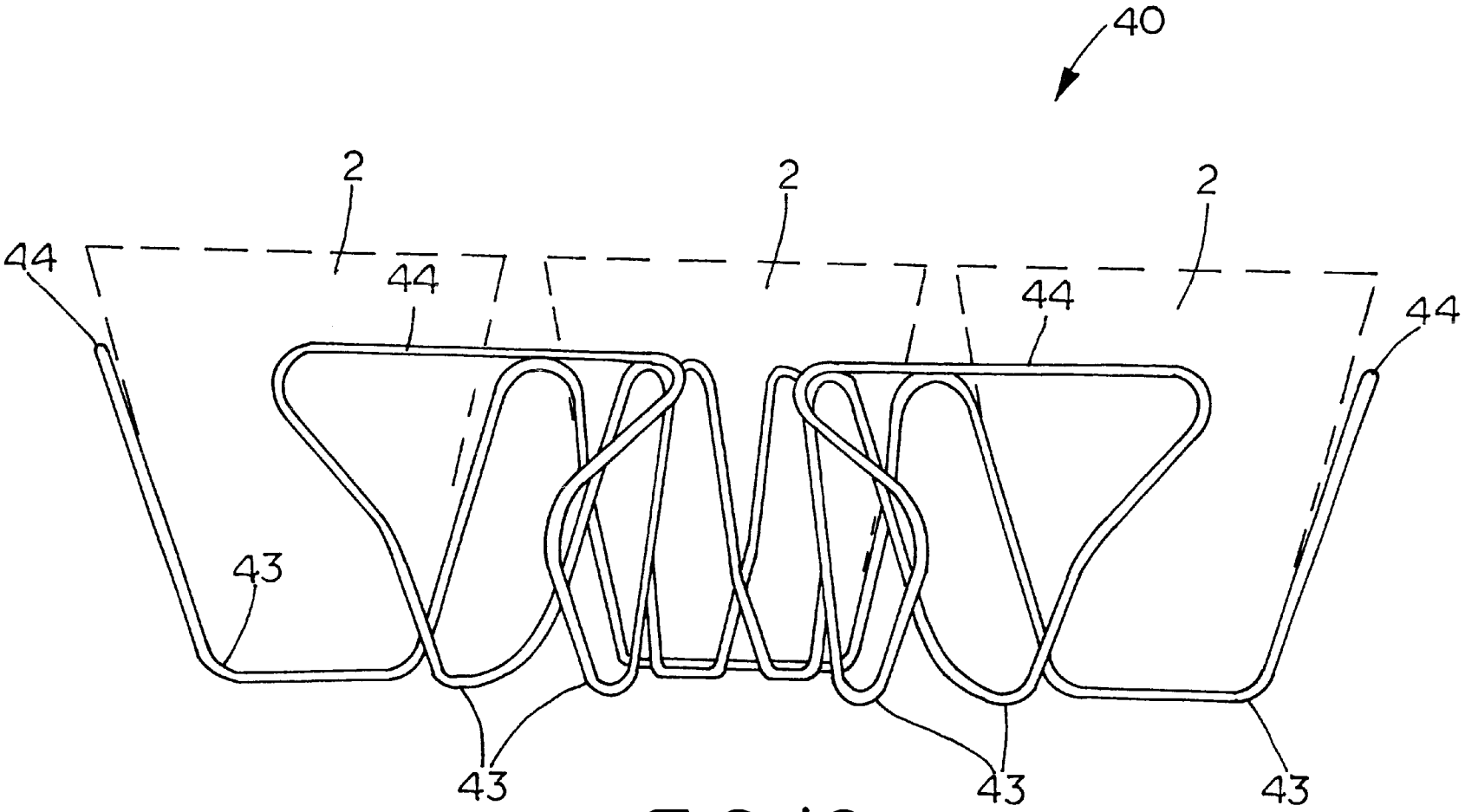
FIG. 10 is a side view of a third embodiment of the stand of this invention.
Figure 11:
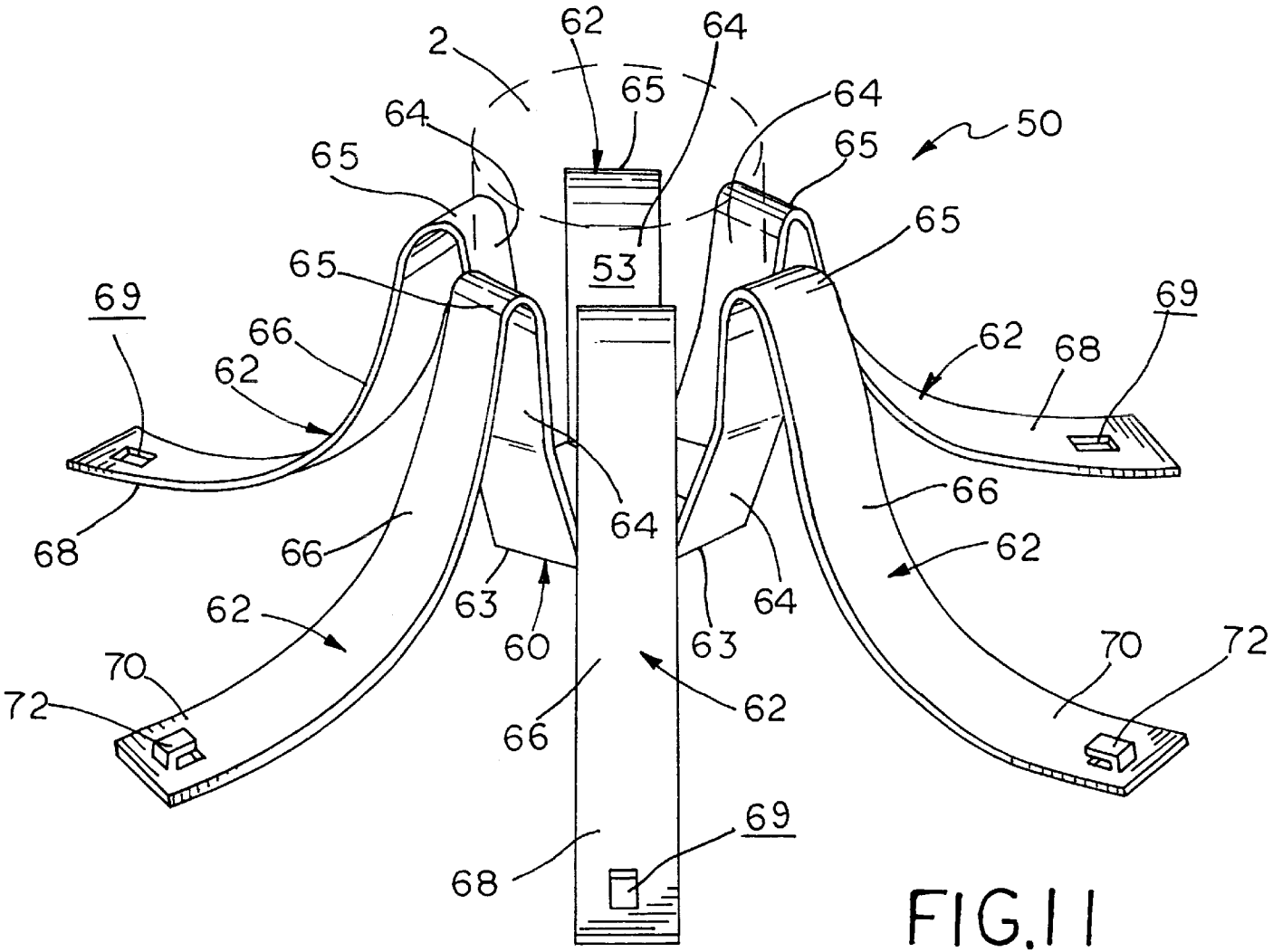
FIG. 11 is a perspective view of a fourth embodiment of the stand of this invention showing a pot in shadow.
Figure 12:
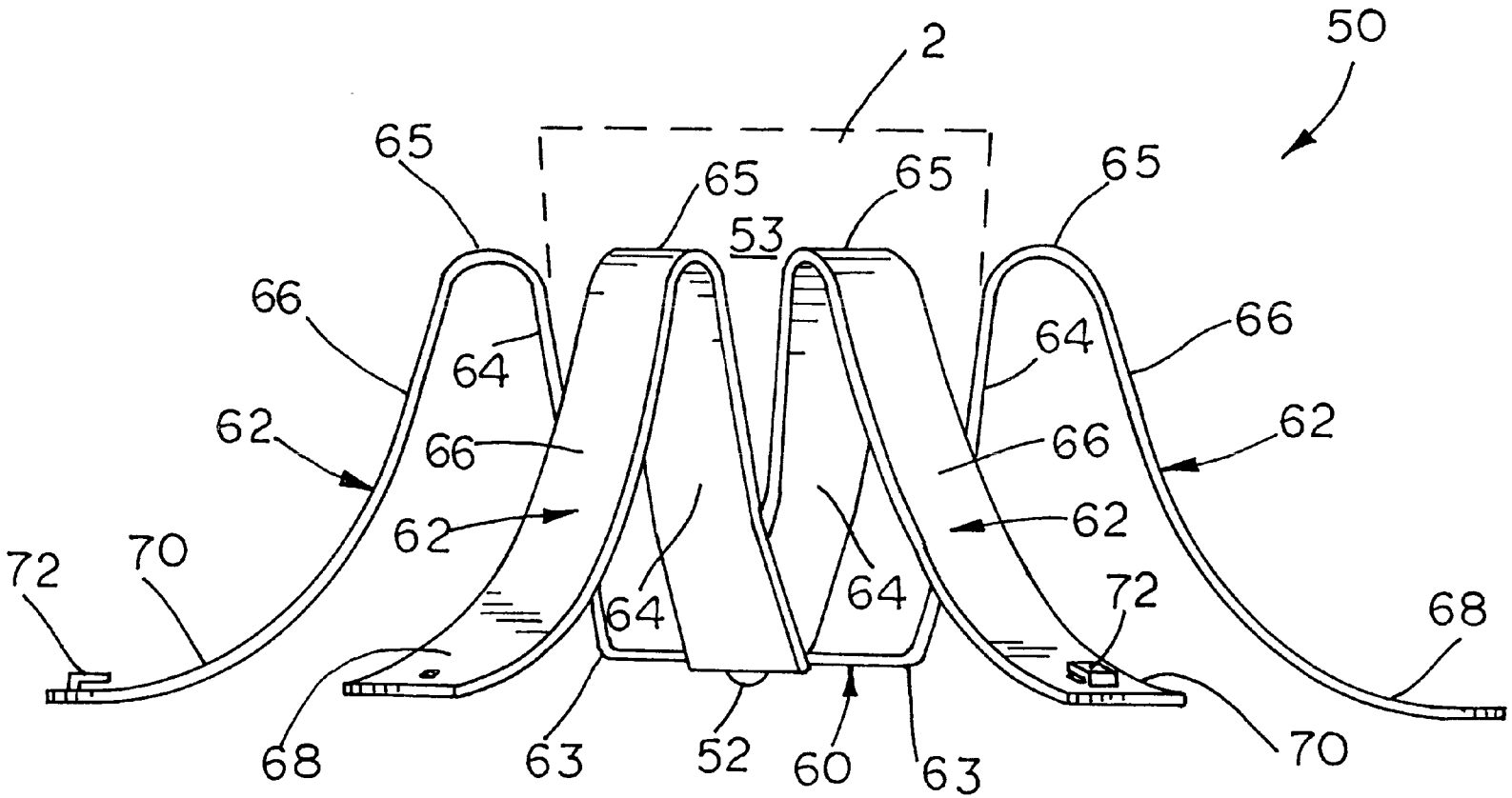
FIG. 12 is a side view of the fourth embodiment of the stand showing a pot in shadow.
Figure 13:
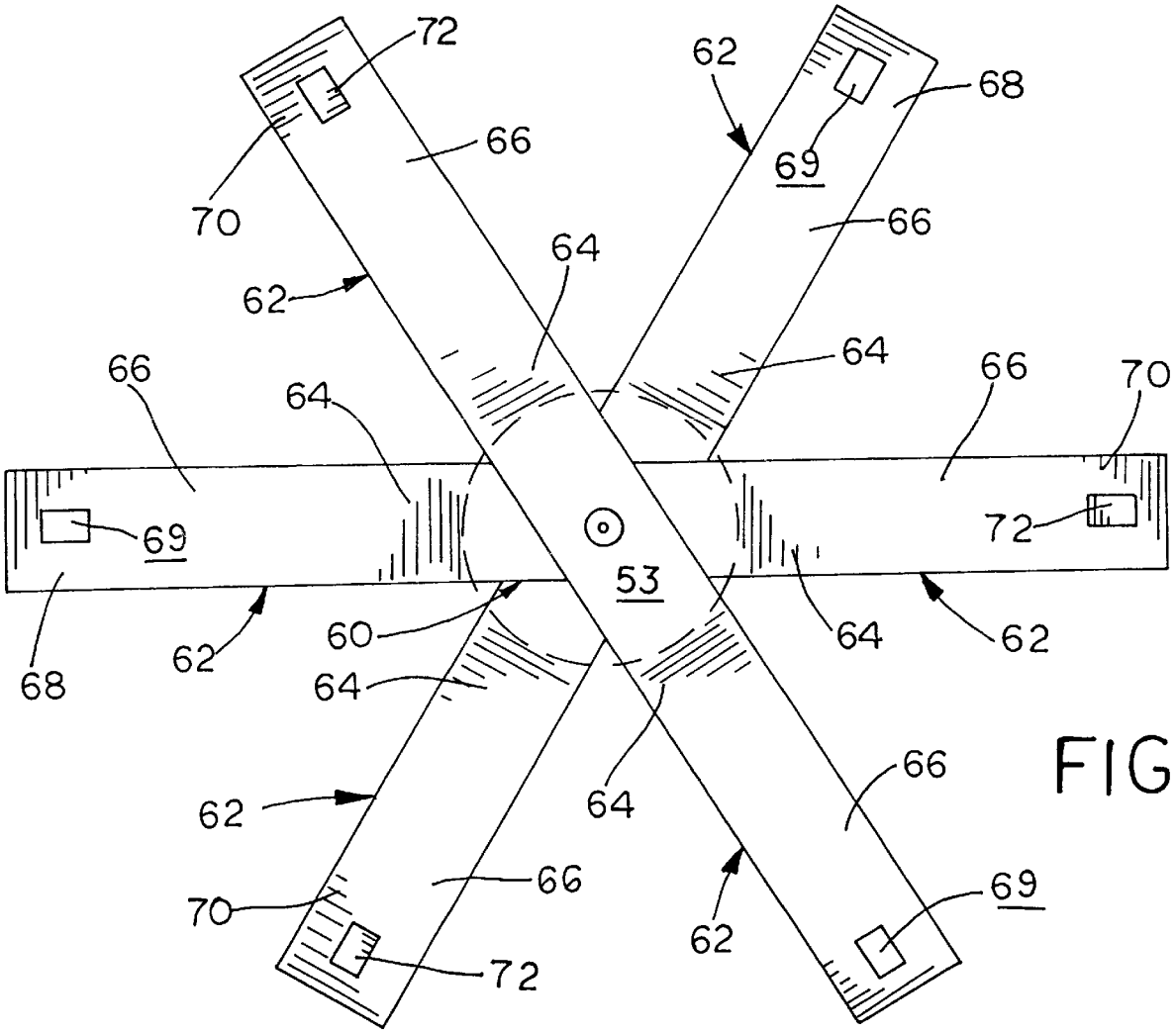
FIG. 13 is a top view of the fourth embodiment of the stand showing a pot in shadow.

FIGS. 8–10 show a third embodiment of the wire lattice stands, generally designated as numeral 40. As shown, stand 30 has the same basic construction as stand 10 of FIGS. 1–4 but allows a single stand to support multiple potting containers 2. As shown, the end of each foot 42 has an upward bend 43 and a raised horizontal cross member 44, which forms part of a annular back for supporting additional pots. As shown, the additional pots are seated between adjacent outer leg segments and cross members 44.

Multiple Band Embodiment

FIGS. 11–18 illustrates another embodiments of the stand of this invention, which is designated generally as numeral 50. Stand 50 has a similar configuration as stand 10 of the first embodiment, except that stand 50 is constructed of three flat elongated bands or strips, rather than a wire lattice. Each band is constructed of a durable and resilient metal or plastic, such as, spring steel or acrylic, which can be bent, and fused, glued or welded while still retaining its resilient properties. The bands are intercrossed and connected together at their centers by a weld or hex rivet 52, to form a base 60 and six legs 62, which extend radially from base 60. The distal ends of each band 52 have an upward (hip) bend 63 on either side of base 60, which forms an inner leg segment 64, and a downward return (knee) bend 65, which forms an outer leg segment 66. The distal ends of each band 52 terminate in a foot 68 or 70.

Figure 14:
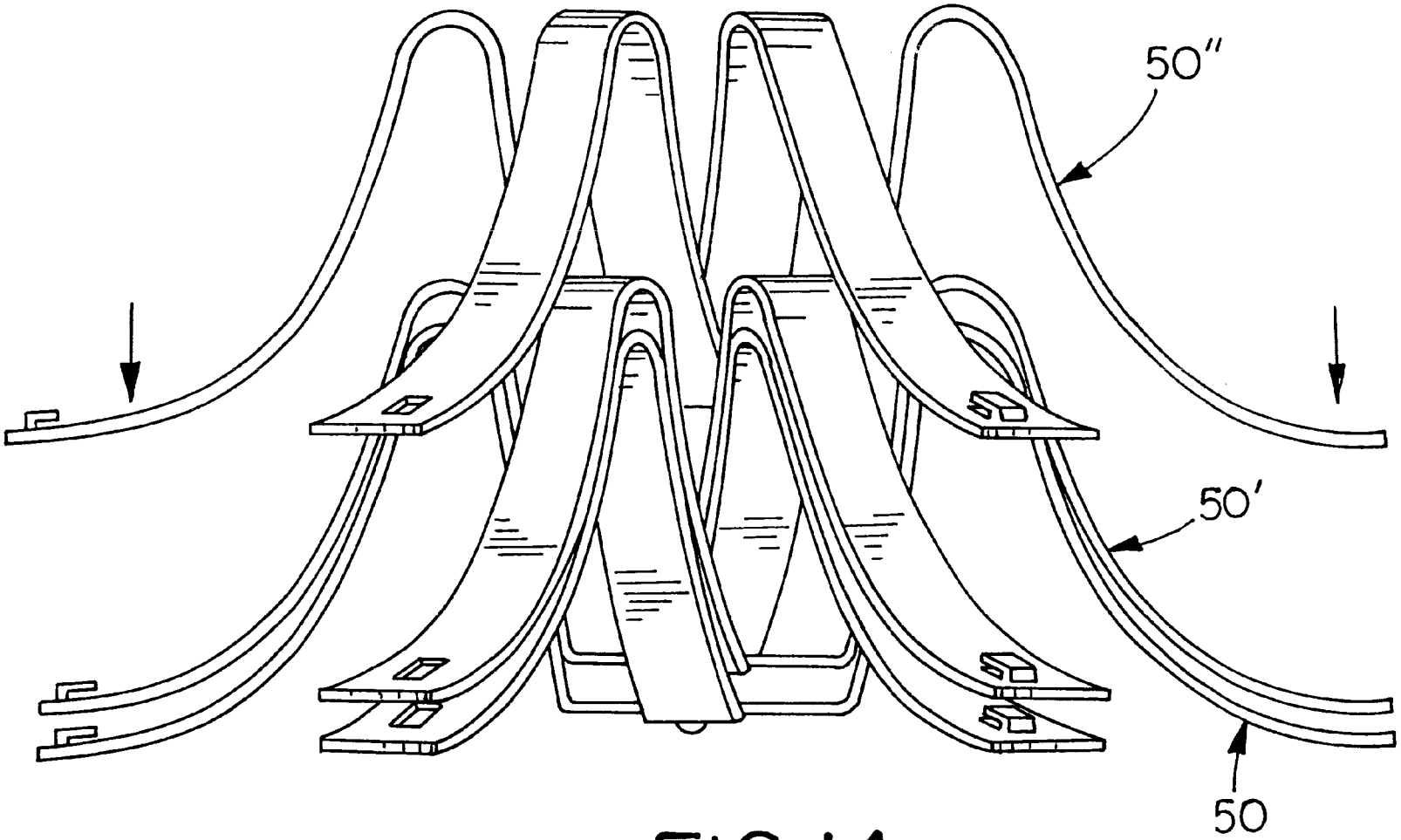
FIG. 14 is a side view of three stands of the fourth embodiment of the stand shown stacked atop one another in a storage position.
Figure 15:
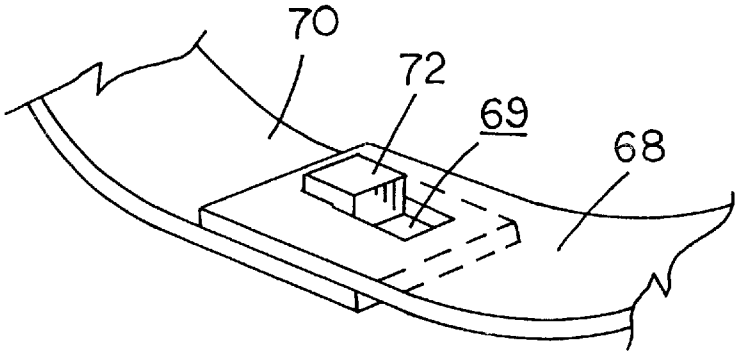
FIG. 15 is a perspective view of the interconnection mechanism of the fourth embodiment of the stand.
Figure 16:
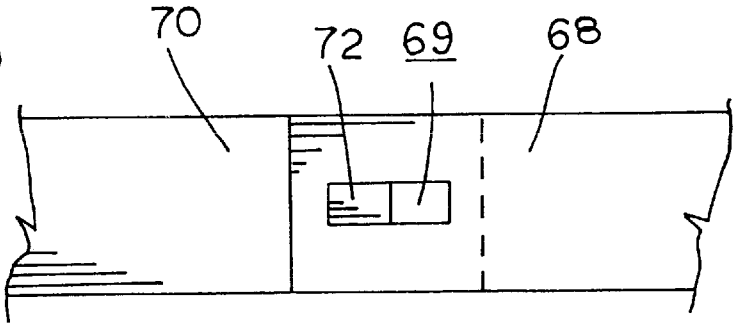
FIG. 16 is a top view of the interconnection mechanism of the fourth embodiment of the stand.
Figure 17:
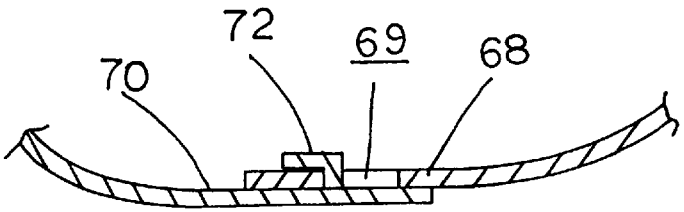
FIG. 17 is a side view of the interconnection mechanism of the fourth embodiment of the stand.
Figure 18:
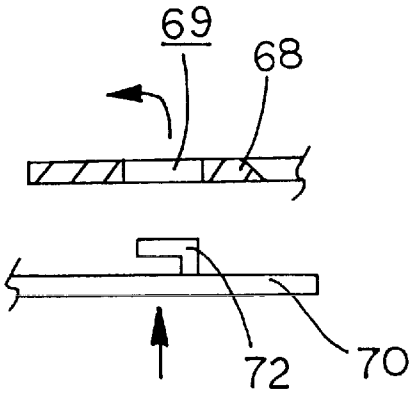
FIG. 18 is a side sectional view of the interconnection mechanism of the fourth embodiment of the stand.

Again, inner leg segments 64 diverge upwardly to define an area 53 for restrictively receiving potting container 2 with side walls 4 of the potting container restrictively held secure against inner leg segments 64. Also, inner leg segments 64 diverge upward at an angle such that side walls 4 of potting container 2 of various dimensions will be in restrictive contact with at least some portion of the inner leg segment to firmly support the potting container within stand 10. Each pair of opposite legs 52 applies some pressure due to the resilience of the bands to container side walls 4 to secure potting container 2 within area 55. FIG. 14 illustrates that the configuration of stands 50 allows multiple stands to be stacked atop each other.

Figure 19:
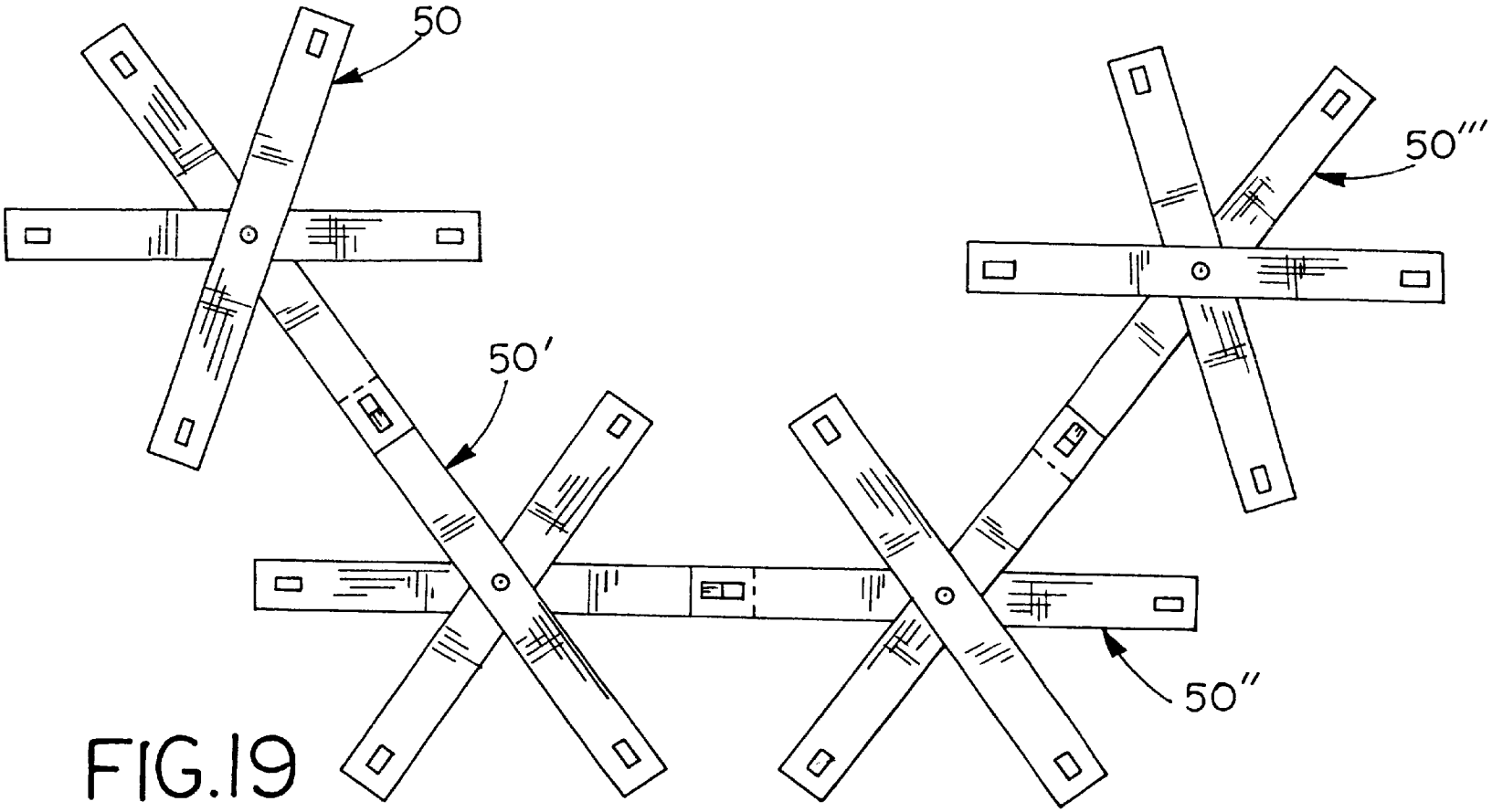
FIG. 19 is a top view of four interconnected stands of the fourth embodiment of the stands of this invention.

As best shown in FIGS. 15–19, feet 68 and 70 have a mechanism for interconnecting multiple stands to support multiple potting containers 2. As shown, one set of alternating feet 68 has a slot 69, which forms the eye of the interconnecting mechanism. The other set of feet 70 has a raised tab, which forms the hook of the interconnecting mechanism. As shown, adjacent stands 50 are interconnected by mating the hook 72 of leg 70 of one stand 30 within eye 69 of foot 68 of another stand 50. In this manner, multiple stands can be interconnected, which allows multiple pots to be supported. As shown in FIG. 19, three stands 50 can be interconnected in a triangular pattern. In addition, the interconnected stands 50 provide a greater securing, since each stand helps support the other interconnected stands.

One skilled in the art will recognize several advantages of the design and operation of the stand of this invention. The six radially extending legs provide a wide stable base to support the potted plants. The radially extending legs of adjacent stands 50 can be interlaced so that stands can be positioned in close proximity. Unused stands can be stacked for storage, which reduces the loss of floor space. Since the radial legs provide a wide base and the stands compact very tightly when stacked, large numbers of stands can be stored within a single tall stack without the stack being unstable. Since the stands are constructed of simple wire lattice or metal strips the stands are relatively inexpensive and durable for heavy commercial use. In addition, two embodiments allow for multiple stands to be interconnected to support multiple potting containers. Interconnecting stands further promotes stable support to the containers.

It is understood that the above description does not limit the invention to the details given, but may be modified within the scope of the following claims.

I claim:

1. A stand for securely supporting potting containers comprising:

a base part and a plurality of legs extending radially from the base, each leg including an inner leg segment adjacent the base diverging angularly upward from the base, and outer leg segment diverging angularly downward from the inner leg segment, the inner leg segments defining therebetween for receiving a potting container between the inner leg segments, one leg includes a first connecting part, another leg includes a second connecting part, the first connecting part constituting means for connectively engaging the second connecting part of a second stand to interconnect the one stand and the second stand, the second connecting part of the one stand constituting means for connectively engaging the first connecting part of the second stand.

2. The stand of claim 1 wherein each of the outer leg segments include a foot segment.

3. The stand of claim 2 wherein the foot segments of each leg diverge angularly upward from the outer leg segment of that leg so as to define a second area therebetween for receiving a potting container between the outer leg segments and the foot segments of each leg.

4. The stand of the claim 1 wherein the first connecting part is an eyelet formed in one of the legs, and the second connecting part is a hook extending from another of the legs.

5. A stand for a potting container having tapered conical sides comprising:

a plurality of flat elongated bands each having a center portion and opposed distal ends, the plurality of bands being integrally connected to each at their centers to form a base and a plurality of legs extending radially from the base, each leg including an inner leg segment adjacent the base diverging angularly upward from the base, and outer leg segment diverging angularly downward from the inner leg segment, the inner leg segments defining therebetween for receiving a potting container between the inner leg segments, one leg includes a first connecting part, another leg includes a second connecting part, the first connecting part constituting means for connectively engaging the second connecting part of a second stand to interconnect the one stand and the second stand, the second connecting part of the one stand constituting means for connectively engaging the first connecting part of the second stand.

6. The stand of claim 5, wherein each of the outer leg segments include a foot segment.

7. The stand of the claim 5 wherein the first connecting part is an eyelet formed in one of the legs, and the second connecting part is a hook extending from another of the legs.

8. A stand for a potting container having tapered conical sides comprising:

a plurality of elongated wire loops, each wire loop having a center portion and opposed distal ends and being interconnected to form a wire lattice, the center portion of the wire loops forming a base and the opposed distal end of the wire loops forming a plurality of legs extending radially from the base part, each leg including an inner leg segment adjacent the base diverging angularly upward from the base, and outer leg segment diverging angularly downward from the inner leg segment, the inner leg segments defining therebetween for receiving a potting container between the inner leg segments.

9. The stand of claim 8 wherein each of the out leg segments include a foot segment.

10. The stand of claim 9 wherein the foot segments of each leg diverge angularly upward from the outer leg segment of that leg so as to define a second area therebetween for receiving a potting container between the outer leg segments and the foot segments of each leg.

11. The stand of claim 8 and means carried by the legs for interconnecting multiple stands together to support multiple potting containers.

12. The stand of claim 11 wherein the interconnecting means includes a first connecting part carried by one of the legs of the stand and a second connecting part carried by one of the legs of the stand, the first connecting part of one stand constituting means for connectively engaging the second connecting part of a second stand to interconnect the one stand and the second stand, the second connecting part of the one stand constituting means for connectively engaging the first connecting part of the second stand.

13. The stand of claim 12 wherein the interconnecting means includes a first connecting part carried by one of the legs of the stand and a second connecting part carried by one of the legs of the stand, the first connecting part of one stand constituting means for connectively engaging the second connecting part of a second stand to interconnect the one stand and the second stand, the second connecting part of the one stand constituting means for connectively engaging the first connecting part of the second stand.

14. The stand of the claim 13 wherein the first connecting part is an upward and return bend formed in one of the feet, and the second connecting part is a cross member formed in another of the feet.

* * * * *